US011738991B1

(12) United States Patent
Smith et al.

(10) Patent No.: US 11,738,991 B1
(45) Date of Patent: Aug. 29, 2023

(54) ANTI-THEFT FUEL DISPENSER PULSAR LOCK AND METHODS OF MAKING AND USING THE SAME

(71) Applicants: Christopher D. Smith, Sanford, NC (US); Garrett R. Jones, Sanford, NC (US)

(72) Inventors: Christopher D. Smith, Sanford, NC (US); Garrett R. Jones, Sanford, NC (US)

( * ) Notice: Subject to any disclaimer, the term of this patent is extended or adjusted under 35 U.S.C. 154(b) by 0 days.

(21) Appl. No.: 18/110,632

(22) Filed: Feb. 16, 2023

(51) Int. Cl.
*B67D 7/34* (2010.01)

(52) U.S. Cl.
CPC ..... *B67D 7/34* (2013.01)

(58) Field of Classification Search
CPC ..... B67D 7/34; B67D 7/84
See application file for complete search history.

(56) References Cited

U.S. PATENT DOCUMENTS 4,418,551 A * 12/1983 Kochackis ..... G07F 9/10 70/164
4,461,401 A * 7/1984 Sasnett, Jr. ..... B67D 7/84 345/204
4,986,445 A * 1/1991 Young ..... B67D 7/84 137/560
6,908,014 B1 * 6/2005 Glover ..... B67D 7/34 222/153.1
2009/0314804 A1 * 12/2009 Kinzie ..... B67D 7/222 222/153.09
2010/0071422 A1 * 3/2010 Kiest ..... B67D 7/84 70/14
2012/0033371 A1 * 2/2012 Pankros ..... F16M 11/10 248/231.91
2015/0148942 A1 * 5/2015 DeWitt ..... G05B 15/02 700/231
2015/0329064 A1 * 11/2015 Baily ..... B60R 11/06 29/525.08
2016/0362289 A1 * 12/2016 Wiebe ..... H02S 40/38
2017/0327369 A1 * 11/2017 Mawdsley ..... B67D 7/84

* cited by examiner

*Primary Examiner* — J C Jacyna
(74) *Attorney, Agent, or Firm* — Ashley D. Johnson; Dogwood Patent and Trademark Law

(57) ABSTRACT

The invention is a pulsar lock device that can be installed on a variety of different gas dispensing pumps to prevent theft of gasoline. The pulsar lock device includes first and second covers that enable the device to be attached to a fuel dispenser frame. The covers also properly position the device adjacent to the pulsar. The pulsar lock further includes a cross bar that spans the distance between the first and second covers and provides support for a block. Advantageously, the block is positioned adjacent to the pulsar, thereby preventing access to the pulsar control board. As a result, the pulsar cannot be accessed and/or manipulated, thereby effectively preventing theft of gasoline by thieves.

15 Claims, 6 Drawing Sheets

ANTI-THEFT FUEL DISPENSER PULSAR LOCK AND METHODS OF MAKING AND USING THE SAME

TECHNICAL FIELD

The presently disclosed subject matter relates to an anti-theft device used with fuel dispensers. Specifically, the disclosed anti-theft devices include a lock feature that prevents access to the dispenser pulsar. Methods of making and using the disclosed anti-theft device is also included.

BACKGROUND

As fuel prices continue to rise, small businesses and global enterprises find themselves paying more for nearly every input and service needed to bring their products to market. In response, consumers have had to adjust because they must pay more at the grocery store, shopping malls, and to fill up their vehicle gas tanks. Moreover, as fuel prices continue to rise, the incentive to steal fuel becomes greater. In regions of the United States, for example, fuel theft has become a significant cost to gas station owners. To counter the problem of fuel theft, gas stations frequently install one or more exterior monitoring cameras that enable the detection of an offender when fuel thefts occurs. However, security cameras are costly to purchase, and monitoring of cameras require ongoing fees. In addition, when stolen vehicles or false license plates are used by the thief, the cameras are ineffective at identifying the offender. Even at gas stations that require pre-payment, thieves have figured out ways to steal gas. For instance, magnets positioned on an exterior surface can manipulate a gas pump in order to trick the pump into allowing a user to indiscriminately dispense as much gas as possible while charging them for only a small fraction of the gasoline. Further, with current gas dispenser and gas station layouts, an attendant may never know theft has begun or occurred, even when security cameras are in use. It would therefore be beneficial to provide a device that overcomes the shortcomings of the prior art. It would further be beneficial to provide a device that prevents and/or deters theft of gasoline at the pump.

SUMMARY

In some embodiments, the presently disclosed subject matter is directed to an anti-theft device. Specifically, the device comprises first and second covers, each cover defined by a first end and an opposed second end, a top face and an opposed bottom face, and an inner edge and an opposed outer edge. Each cover includes an arm extending upwards from the top face at the first and second ends of each cover. Each cover further includes a lip extending downward from the bottom face, along the length of the outer edge of each cover. Each cover includes a cutout positioned along the inner edge of each cover. The device includes a cross bar extending across the top face of each cover, the cross bar defined by a top face and an opposed bottom face, wherein the cross bar spans a distance between the first and second covers. The device incudes a support block extending upwards from the top face of the cross bar, wherein the block includes a first face and an opposed second face. The support block is positioned above the distance between the first and second covers.

In some embodiments, each arm is horizontal relative to the top face of the first and second covers.

In some embodiments, each arm comprises a length of about 0.5-5 inches.

In some embodiments, each lip comprises a width of about 0.1-5 inches.

In some embodiments, each cover comprises a length of about 20-60 inches and a width of about 2-10 inches.

In some embodiments, the cross bar has a length of about 2-15 inches and a width of about 0.1-5 inches.

In some embodiments, the support block is perpendicular to the cross bar.

In some embodiments, the support block first face is flat and the second face is concave and extends inward towards the first face.

In some embodiments, the support block has a length of about 2-15 inches, a height of about 2-15 inches, and a thickness of about 0.5-5 inches.

In some embodiments, the device is constructed from one or more metallic materials. The term "metallic materials" comprises elemental metals, metal alloys, and metal compounds.

In some embodiments, the presently disclosed subject matter is directed to a method of preventing manipulation of and/or access to a gas dispenser pulsar or the control panel of a gas dispenser pulsar. Specifically, the method comprises positioning the disclosed device within an interior of a gas dispenser, the gas dispenser defined by a frame and a pulsar comprising a control panel, wherein the pulsar is positioned within a channel comprising upwardly extending channel walls. The first and second covers are positioned over the upwardly extending channel walls such that each lip is configured on an outer side of a channel wall. Each arm extends upward to contact the frame of the gas dispenser. The first face of the support block is positioned adjacent to the control panel of the pulsar to thereby prevent manipulation of and/or access to the pulsar and/or pulsar control panel.

In some embodiments, the first face is positioned directly adjacent to the control panel of the pulsar.

In some embodiments, each arm is permanently or removably attached to the frame.

In some embodiments, preventing manipulation of the pulsar prevents theft of gasoline from the gas dispenser.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1:
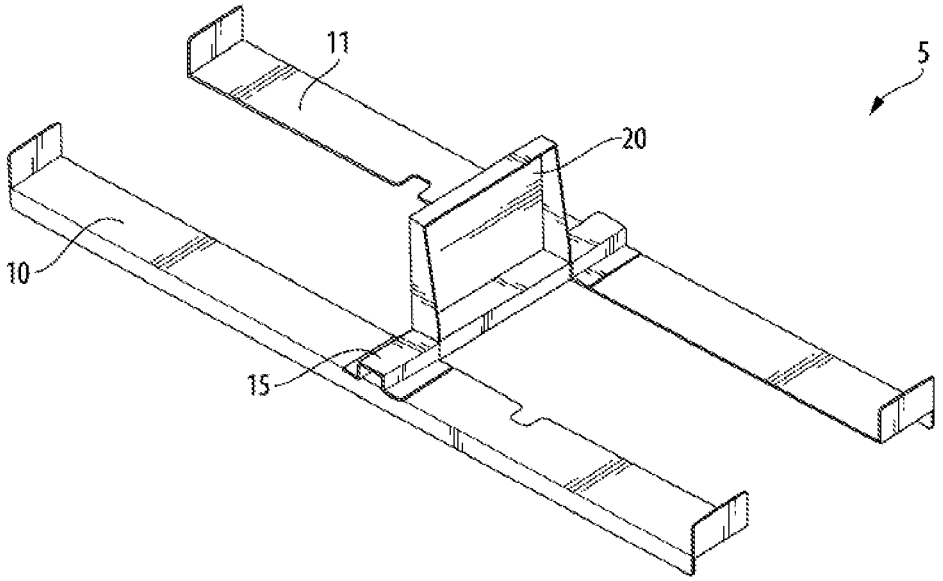
FIG. 1 is a perspective view of a pulsar lock device in accordance with some embodiments of the presently disclosed subject matter.

The presently disclosed subject matter is directed to a pulsar lock device that can be installed on a variety of different gas dispensing pumps to prevent theft of gasoline. The term "pulsar" refers to an element present within the interior of a gas dispenser that regulates the flow of the fuel. A "pulsar block" therefore refers to a device that blocks the manipulation of the pulsar using any suitable method, such as (but not limited to) blocking access to the pulsar control panel. The term "gas dispenser" refers to any of a wide variety of pumps that dispense gasoline into a vehicle. As shown in FIG. 1, pulsar lock device 5 includes first and second covers 10, 11 that enable the device to be attached to a fuel dispenser frame. The covers also properly position the device adjacent to the pulsar, as described in detail below. The pulsar lock further includes cross bar 15 that spans the distance between the first and second covers and provides support for block 20. Advantageously, the block is positioned adjacent to the pulsar, thereby preventing access to the pulsar control board. As a result, the pulsar cannot be accessed and/or manipulated, thereby effectively preventing theft of gasoline by thieves.

Figure 2A:
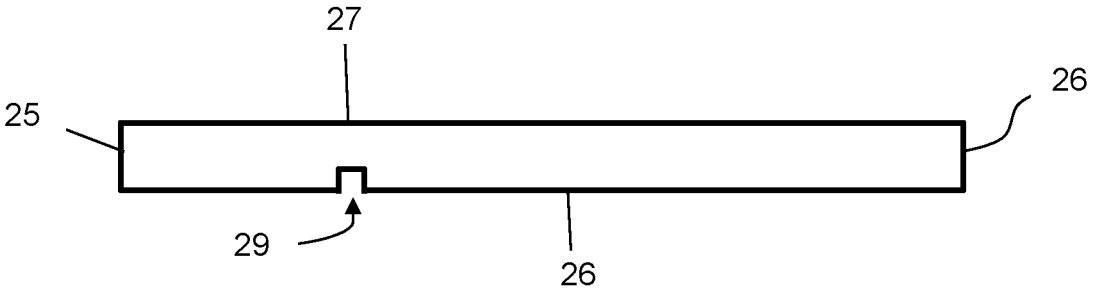
FIG. 2*a* is a top plan view of a device cover in accordance with some embodiments of the presently disclosed subject matter.

A set forth above, pulsar lock device 5 includes a pair of covers 10, 11. FIG. 2*a* illustrates one embodiment of a cover that can be used with the disclosed pulsar lock device. As shown, each cover can be configured planar in design with front edge 25, opposed rear edge 26, outer edge 27, and inner edge 28. The term "inner edge" refers to the device edge that faces a pulsar when installed. The term "outer edge" refers to the device edge that faces away from the pulsar when installed. Each cover further includes top face 30 and opposed bottom face 31, as shown in FIG. 2*b*.

Each cover inner edge 26 includes cut-out 29 that is sized and shaped to accommodate a dispensing pump printer. Each cut-out can be configured in any suitable size and shape. In some embodiments, each cover includes a cut-out positioned on the inner edge about one-third of the total length of the cover from the first or second end. It should be appreciated that the presently disclosed subject matter also includes embodiments where the covers lack the printer cut-out 29 and other techniques are used to accommodate a dispenser printer.

Covers 10, 11 can be configured in any desired shape, such as (but not limited to) rectangular, square, and the like. It should be appreciated that any shape can be used.

Figure 2B:
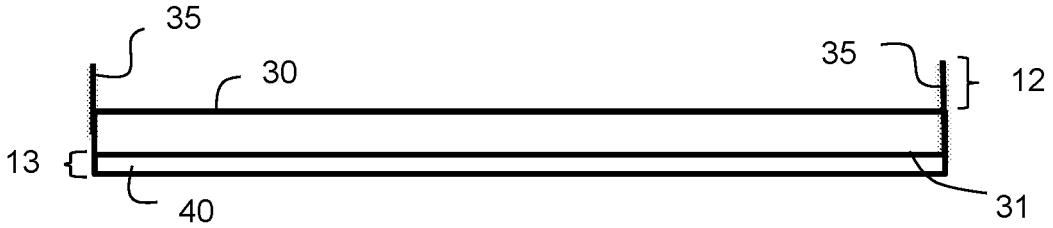
FIG. 2*b* is a side plan view of a device cover in accordance with some embodiments of the presently disclosed subject matter.
Figure 2C:
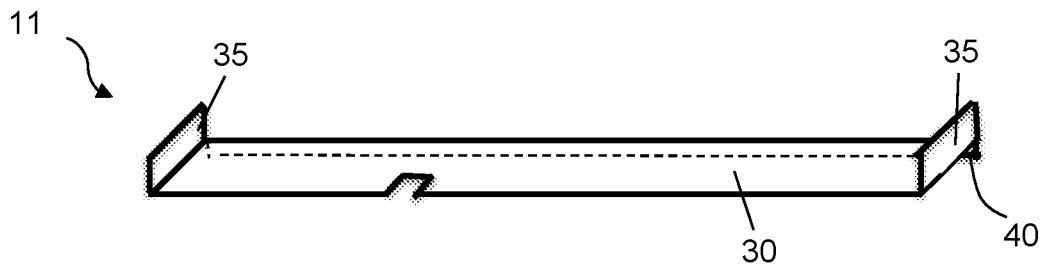
FIGS. 2*c* and 2*d* are perspective view of device covers in accordance with some embodiments of the presently disclosed subject matter.
Figure 2D:
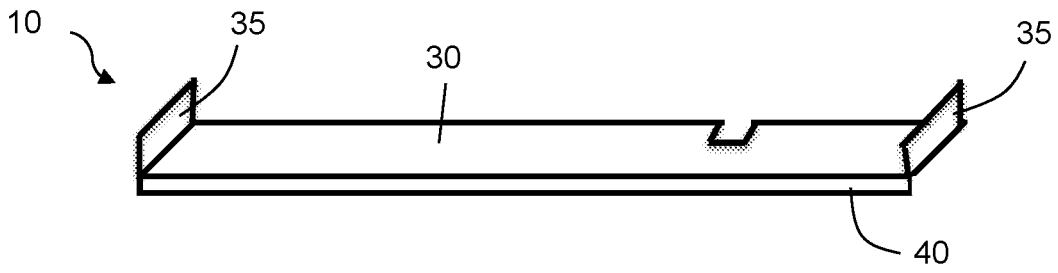

As shown in FIGS. 2*b*-2*d*, each cover 10, 11 includes arms 35 extending upwards away from top face 30 at each of the front and rear edges. In some embodiments, the arms are horizontal relative to the top face of each cover. In other embodiments, the arms can be angled relative to the top face of each cover. The arms allow each end of the cover to attach to a corresponding fuel dispenser frame. The arms can attach using any suitable method, such as (but not limited to) the use of mechanical elements (bolts, screws, fasteners, staples, clips, and the like), welding, adhesive, magnets, etc. Each arm can have length 12 of about 0.5-5 inches (e.g., at least/no more than about 0.5, 1, 1.5, 2, 2.5, 3, 3.5, 4, 4.5, or 5 inches). It should be appreciated that the length of the arms can be greater or less than the range given above.

Each frame further includes lip 40 that extends in a downward direction from the bottom face at outer edge 27. In some embodiments, each lip is about perpendicular relative the bottom face of each cover. In other embodiments, the lip can be angled relative to the bottom face of each cover. The lip can have the same length as a corresponding cover in some embodiments. In other embodiments, the lip can have a length that is about 50, 60, 70, 80, 90, or 99 percent of the length of the corresponding cover. Each lip can include width 13 of about 0.1-5 inches (e.g., at least/no more than about 0.1, 0.5, 1, 1.5, 2, 2.5, 3, 3.5, 4, 4.5, or 5 inches). It should be appreciated that the width of the lip can be greater or less than the range given above. Each lip can have a thickness of about 0.1-2 inches in some embodiments.

Figure 2E:
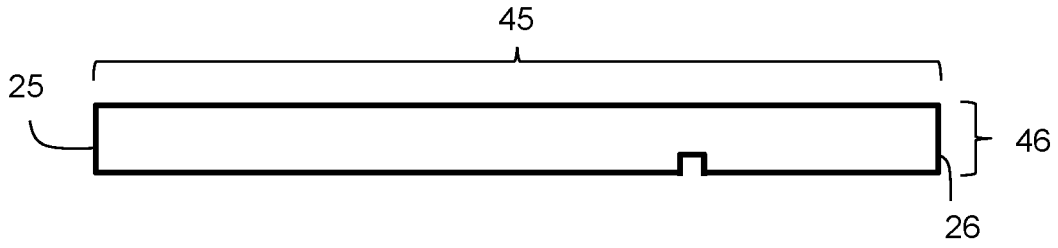
FIG. 2*e* is a top plan view of a device cover in accordance with some embodiments of the presently disclosed subject matter.

As illustrated in FIG. 2*e*, each cover includes length 45 of about 20-60 inches in some embodiments. Thus, each cover can have a length of at least about (or no more than about) 20, 25, 30, 35, 40, 45, 50, 55, or 60 inches. The term "length" refers to the longest straight-line distance between first and second ends 25 and 26. Each cover can also have width 46 of about 2-10 inches (e.g., at least/no more than about 2, 3, 4, 5, 6, 7, 8, 9, or 10 inches). The term "width" refers to the longest straight line distance perpendicular to the length (e.g., the distance between the cover inner and outer edges). The cover can include a thickness of about 0.1 to 2 inches (e.g., at least/no more than about 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9 or 2 inches). The term "thickness" refers to the longest vertical distance between the top and bottom faces of the covers. It should be appreciated that the length, width, and thickness of each cover can be greater or less than the ranges given herein.

Figure 3A:
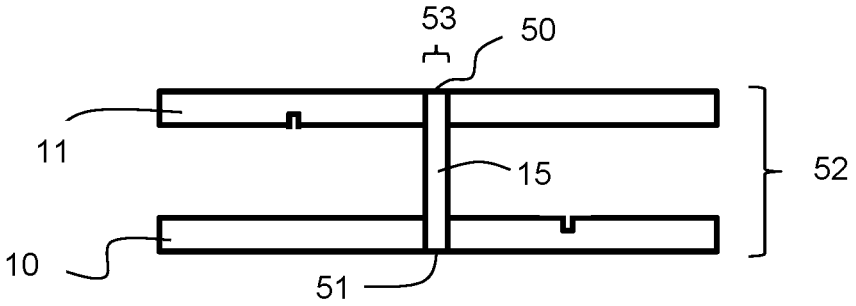
FIG. 3*a* is a top plan view of a cross bar positioned on first and second covers in accordance with some embodiments of the presently disclosed subject matter.

As noted above, the first and second covers are linked together via cross bar 15 positioned adjacent to the top face of each cover, as shown in FIG. 3*a*. The cross bar therefore functions to join the covers together and acts as a support surface for block 20. Each cross bar includes first and second ends 50, 51 with length 52 therebetween. The length of each crossbar can be about 2-15 inches (e.g., at least/no more than about 2, 3, 4, 5, 6, 7, 8, 9, 10, 11, 12, 13, 14, or 15 inches). Each cross bar can include width 53 of about 0.1-5 inches (e.g., at least/no more than about 0.1, 0.2, 0.3, 0.4, 0.5, 1, 1.5, 2, 2.5, 3, 3.5, 4, 4.5, or 5 inches). Each cross bar can further include a thickness of about 0.1 to 2 inches (e.g., at least/no more than about 0.1, 0.2, 0.3, 0.4, 0.5, 0.6, 0.7, 0.8, 0.9, 1, 1.1, 1.2, 1.3, 1.4, 1.5, 1.6, 1.7, 1.8, 1.9 or 2 inches). The "thickness" of each cross bar is the longest vertical distance from a cross bar top face to a bottom face. It should be appreciated that the length, thickness, and width of each cross bar can be configured to be greater or less than the ranges given above.

Figure 3B:
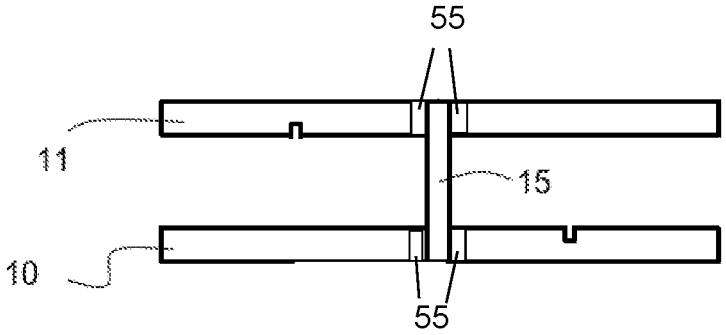
FIG. 3*b* is a top plan view of a cross bar and cross bar keepers positioned on a pair of covers in accordance with some embodiments of the presently disclosed subject matter.

In some embodiments, cross bar 15 is joined to the top face of covers 10, 15 using keepers 55, as shown in FIG. 3*b*. The term "keeper" can refer to any element that allows for permanent or releasable attachment of the crossbar to the covers. Suitable keepers can include (but are not limited to) bolts, screws, joints, staples, magnets, adhesives, welding, and the like. Any method that can permanently or removably attached a cross bar to the covers can be used.

It should be appreciated that in some embodiments, device 5 includes a single cross bar 15. However, it is envisioned that the disclosed device can include any number of cross bars, such as to provide added support to the device.

Figure 4A:
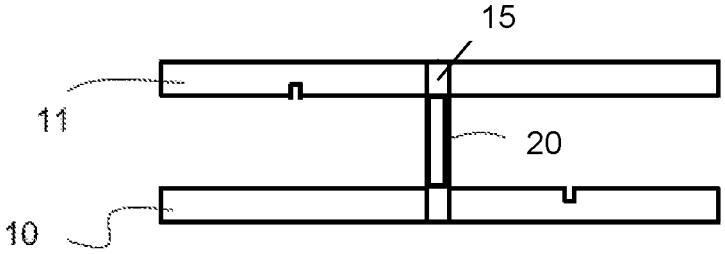
FIG. 4*a* is a top plan view of a device comprising a block in accordance with some embodiments of the presently disclosed subject matter.
Figure 4B:
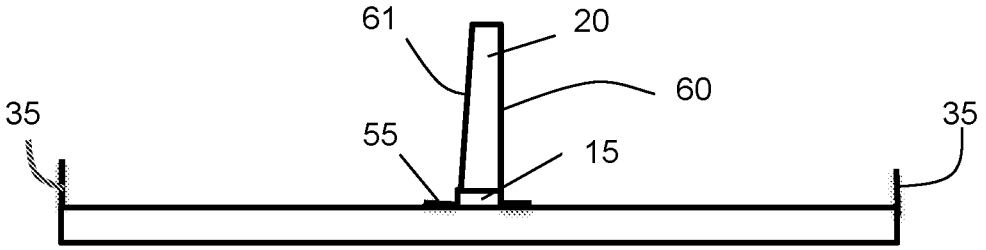
FIG. 4*b* is a side plan view of a device comprising a block in accordance with some embodiments of the presently disclosed subject matter.
Figure 4C:
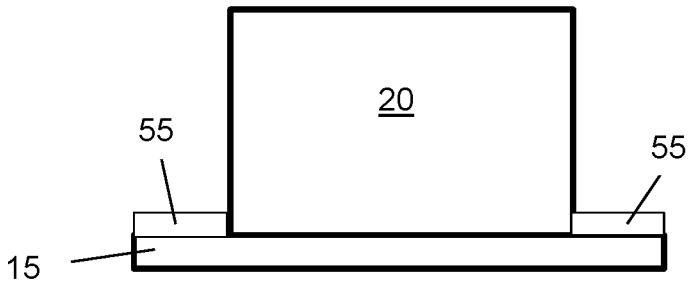
FIG. 4*c* is a front plan view of a device block configured on a cross bar in accordance with some embodiments of the presently disclosed subject matter.

The cross bar also functions to support block 20, as noted above. Specifically, cross bar 15 supports the weight of the block and properly positions the block at a suitable location relative to a dispenser pulsar. As shown in FIGS. 4*a*-4*c*, support block 20 extends upward from the cross bar, between the first and second covers. In some embodiments, the support block is about perpendicular relative to the cross bar. The support block includes first face 60 that is positioned against the dispenser pulsar when in use. In some embodiments, first face 60 is directly adjacent (e.g., contacting) the control face of the pulsar. In other embodiments, the first face is adjacent to the control face of the pulsar (e.g., positioned next to but not directly touching). The control face of the pulsar can include circuitry and any elements that can be accessed to manipulate the flow of gasoline from the dispenser pump.

Figure 4D:
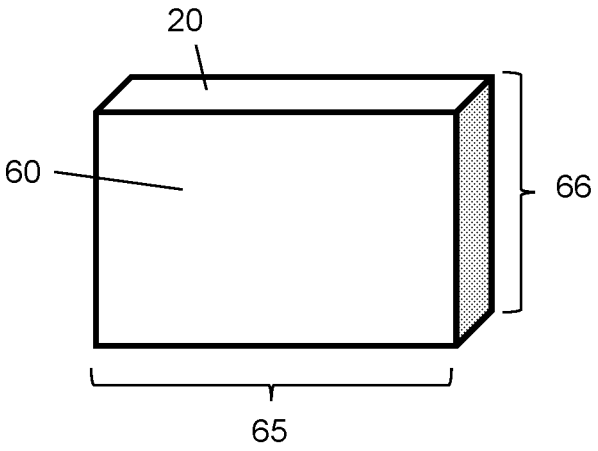
FIGS. 4*d* and 4*e* are perspective views of first and second faces of a device block in accordance with some embodiments of the presently disclosed subject matter.
Figure 4E:
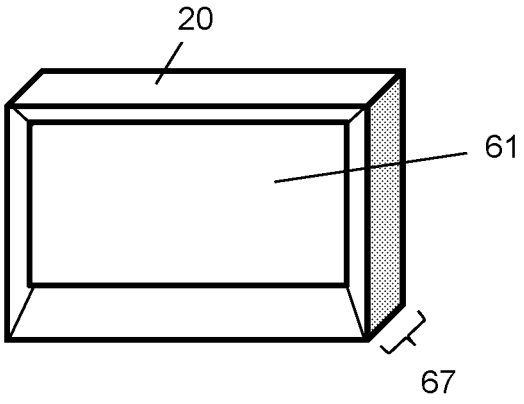

First face 60 is solid, allowing it to rest adjacent and flush with the control panel, as illustrated in FIG. 4*d*. Opposed second side 61 of the support block is concave with an interior that extends into the center of the support block, as shown in FIG. 4*e*. Second side 61 can extend inward with a thickness of about 0.1-2 inches (e.g., at least/no more than about 0.1, 0.2, 0.3, 0.4, 0.5, 0.6, 0.7, 0.8, 0.9, 1, 1.1, 1.2, 13, 1.4, 1.5, 1.6, 1.7, 1.8, 1.9, or 2 inches).

The block can have length 65 and/or height 66 of about 2-15 inches (e.g., at least/no more than about 2, 3, 4, 5, 6, 7, 8, 9, 10, 11, 12, 13, 14, or 15 inches). The block can further include thickness 67 of about 0.5-5 inches (0.5, 1, 1.5, 2, 2.5, 3, 3.5, 4, 4.5, or 5 inches). However, it is to be understood that the length, width, and thickness of block 20 is not limited to the ranges given herein.

Support block 20 can be configured in any desired shape, so long as it blocks the pulsar control panel. Thus, the support block can be configured in a square, rectangular, trapezoidal, or any shape. In some embodiments, one face of the support block can taper as shown in the embodiment of FIG. 4*b* to correctly lie flush against the control panel.

The disclosed device 5 can be constructed from any suitable material, such as (but not limited to) metal (e.g., steel, stainless steel). Any suitable method can be used to construct the disclosed device, including the use of welding, thermoforming, and other known methods.

Figure 5:
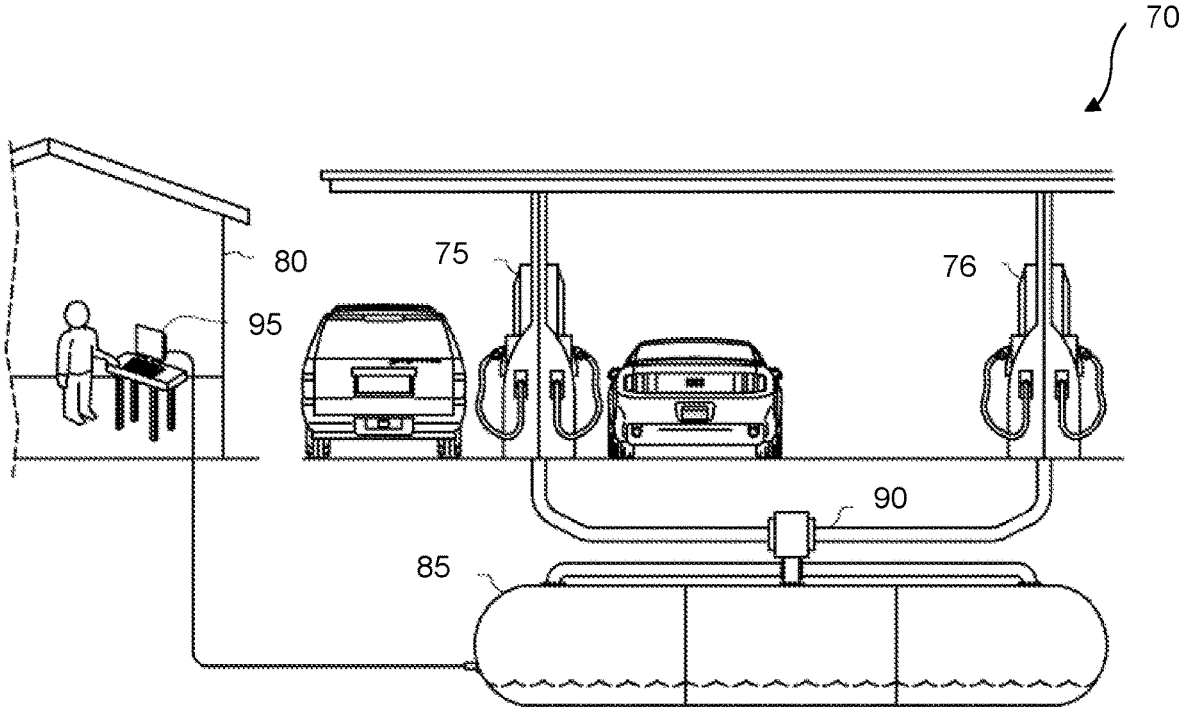
FIG. 5 is a front plan view of a typical gasoline station configuration in accordance with some embodiments of the presently disclosed subject matter.

In use, device 5 can be assembled on a standard fuel dispenser at a typical gas station. For example, the gas pumps can be Gilbarco Encore 500™ and Encore 700™ series dispensers. Any medium or low flow fuel dispenser (e.g., those that pump in the range of 5, 10, 15, or 20 gallons per minute) can be used. FIG. 5 illustrates one embodiment of a typical gas station 70. Gas dispensers 75, 76 allow users to pump gas and customers pay either at the pumps or at kiosk 80 (or inside an associated store). The pumps connect to tank 85 via piping 90. Tank 85 holds a large volume of gasoline that is distributed to the individual gas dispensers as needed. Kiosk 80 comprises a meter with a connection to sensors on the tanks to measure the fluid level inside. Thieves can manipulate the gas dispensers via the dispenser pulsar such that a dispenser will pump fuel without a purchase being made. An employee monitoring the meter via computer 95 may not realize a theft has occurred because meter tracks the entire tank, not the individual pumps. Further, the gas being stolen may not appear large compared to the size of tank.

Figure 6:
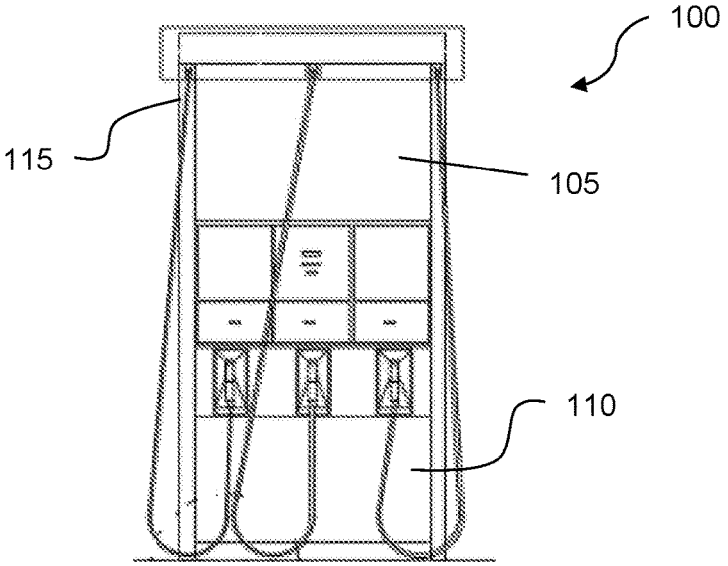
FIG. 6 is a front plan view of a conventional gas dispenser in accordance with some embodiments of the presently disclosed subject matter.

To install the disclosed device on a gas dispenser, at least a portion of the dispenser can be disassembled (thereby providing access to the dispenser pulsar configured within the dispenser interior). As illustrated in FIG. 6, upper doors 100 of a standard fuel dispenser 105 can be unlocked (or removed in some models). The dispenser lower doors 110 and/or side panels 115 can also then removed or opened, revealing the interior components of the dispenser.

In addition, the power source of the gas dispenser can be removed (for safety). The shear valves on each fuel grade in the dispenser can be tripped. The shear valves are installed on fuel supply lines beneath dispensers at grade level to minimize hazards associated with collision or fire at the dispenser. When the shear valves are tripped, poppets are activated that shut off the flow of fuel. The dispenser printer can also be removed if not positioned on the dispenser door. Removal of the printer and power source can give access to the pulsar, allowing for proper placement of device 5.

Figure 7:
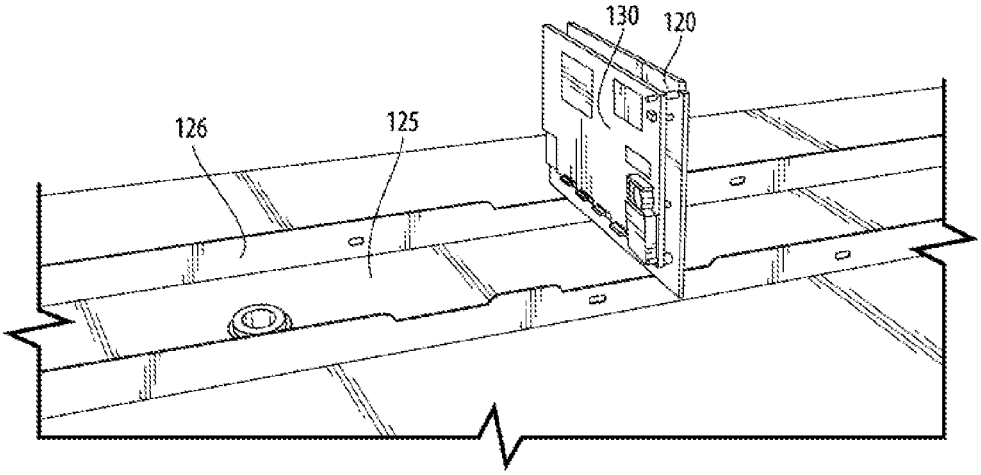
FIG. 7 is a perspective view of a pulsar setup within the interior of a gas dispenser in accordance with some embodiments of the presently disclosed subject matter.

Typically, pulsar 120 is positioned within the interior of a gas dispenser, held in place within channel 125, as shown in FIG. 7. As noted above, the dispenser fuel pulsar is positioned within the dispenser interior and converts the amount of fuel coming through the pump into a price on the display screen of the dispenser. Specifically, the pulsar rotates and measures how much fuel is being dispensed. Pulsar manipulators can be used to interfere with the pulsar and prevent it from measuring how much fuel is being dispensed. Importantly, when the device pulsar is tampered with, large amounts of gasoline can be obtained for a small percentage of the cost.

Figure 8:
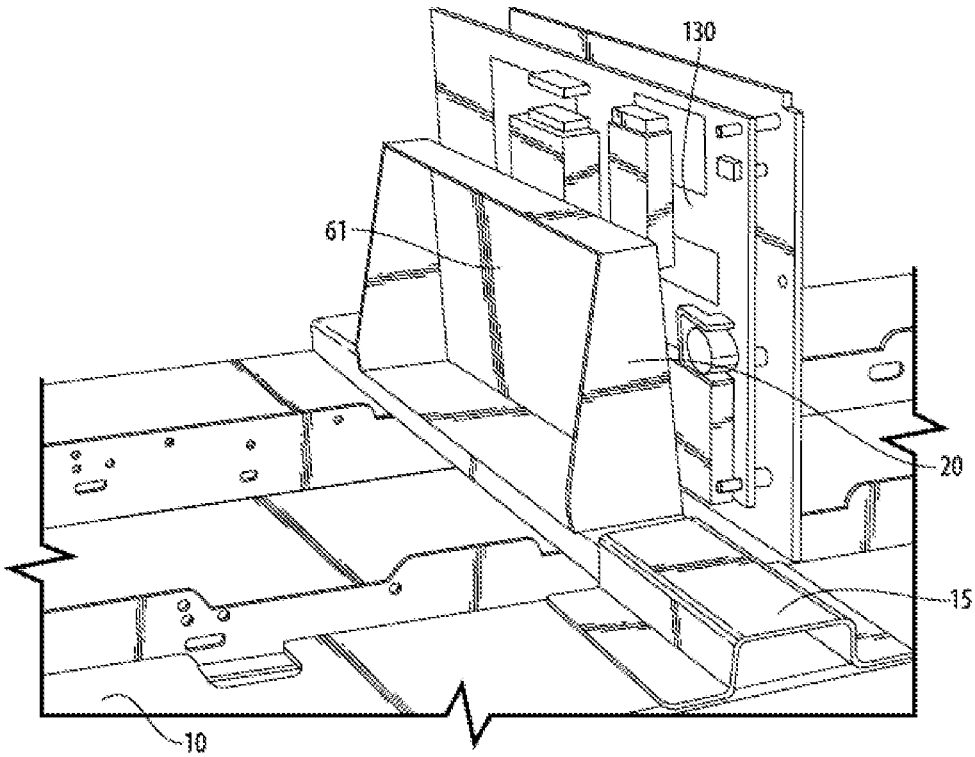
FIG. 8 is a perspective view of an anti-theft device installed adjacent to a pulsar within the interior of a gas dispenser in accordance with some embodiments of the presently disclosed subject matter.

During installation, at least one cover is positioned over walls 126 of channel 125 such that each lip 40 rests on the outside of the channel walls, thereby securing the covers in place and preventing unwanted movement. When the covers are properly positioned, first side 60 of block 20 is positioned adjacent or directly adjacent to control panel 130 of pulsar 120, as illustrated in FIG. 8. In some embodiments, when the cover is attached, there should be about ⅛ inch of clearance from the top of the pulsers. If both covers have not been installed, while supporting the block, the second cover is then slid into place, completing installation. The arms of each cover can be drilled or otherwise attached to each side of the dispenser frame using standard techniques. In this way, device 5 is secured within the interior of gas dispenser 100, with block 20 covering and protecting the control panel of the dispenser pulsar from manipulation by a thief. In this way, theft of gasoline is prevented from the gas dispenser.

The printer can then be reinstalled, if necessary. The dispenser power source can also be reinserted into the dispenser interior and the shear valves reset. The upper doors can then be closed/reinstalled, along with the side panels and lower doors of the dispenser. Advantageously, the control panel of the dispenser pulsar is inaccessible by thieves while device 5 is installed, thereby preventing the theft of gasoline from the pump.

The presently disclosed device and method offer many advantages over current systems. For example, when device 5 is installed such that block 20 is positioned over and protecting the control panel of the gasoline pump pulsar, the pulsar cannot be manipulated (e.g., to steal gasoline).

The disclosed device can be easily and efficiently installed on existing gasoline pumps by those skilled and familiar with installation systems.

The disclosed device is durable and can remain in position within the interior housing of the gas dispenser for at least several weeks, months, or years.

Device 5 can save significant amounts of money from being lost by gas stations by preventing manipulation of pulsar 120.

The disclosed device cannot be easily removed by thieves because it is bolted or otherwise affixed into place via arms 55 attaching to the interior frame of the gas pump.

Although the present invention and its advantages have been described in detail, various changes, substitutions and alterations can be made herein without departing from the spirit and scope of the invention as defined by the appended claims. Moreover, the scope of the present application is not intended to be limited to the embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An anti-theft device comprising:

first and second covers, each cover defined by:

a first end and an opposed second end;

a top face and an opposed bottom face;

an inner edge and an opposed outer edge;

an arm extending upwards from the top face at the first and second ends of each cover;

a lip extending downward from the bottom face, along the length of the outer edge of each cover;

a cutout positioned along the inner edge of each cover;

a cross bar extending across the top face of each cover, the cross bar defined by a top face and an opposed bottom face, wherein the cross bar spans a distance between the first and second covers;

a support block extending upwards from the top face of the cross bar, wherein the block includes a first face and an opposed second face;

wherein the support block is positioned above the distance between the first and second covers.

2. The device of claim 1, wherein each arm is horizontal relative to the top face of the first and second covers.

3. The device of claim 1, wherein each arm comprises a length of about 0.5-5 inches.

4. The device of claim 1, wherein each lip comprises a width of about 0.1-5 inches.

5. The device of claim 1, wherein each cover comprises a length of about 20-60 inches and a width of about 2-10 inches.

6. The device of claim 1, wherein the cross bar has a length of about 2-15 inches and a width of about 0.1-5 inches.

7. The device of claim 1, wherein the support block is perpendicular to the cross bar.

8. The device of claim 1, the support block first face is flat and the second face is concave and extends inward towards the first face.

9. The device of claim 1, wherein the support block has a length of about 2-15 inches, a height of about 2-15 inches, and a thickness of about 0.5-5 inches.

10. The device of claim 1, constructed from one or more metallic materials.

11. A method of preventing manipulation of a gas dispenser pulsar, the method comprising:

positioning the device of claim 1 within an interior of a gas dispenser, the gas dispenser defined by a frame and a pulsar comprising a control panel, wherein the pulsar is positioned within a channel comprising upwardly extending channel walls;

wherein the first and second covers are positioned over the upwardly extending channel walls such that each lip is configured on an outer side of a channel wall;

wherein each arm extends upward to contact the frame of the gas dispenser;

wherein the first face of the support block is positioned adjacent to the control panel of the pulsar to thereby prevent manipulation of the pulsar.

12. The method of claim 11, wherein the first face is positioned directly adjacent to the control panel of the pulsar.

13. The method of claim 11, wherein preventing manipulation of the pulsar prevents theft of gasoline from the gas dispenser.

14. The method of claim 11, wherein the support block first face is flat and the second face is concave and extends inward towards the first face.

15. The method of claim 11, wherein the support block is perpendicular to the cross bar.

* * * * *